US008388388B2

(12) United States Patent
Suzuki et al.

(10) Patent No.: US 8,388,388 B2
(45) Date of Patent: Mar. 5, 2013

(54) ELECTRICAL CONNECTOR WITH TERMINAL ORIENTATION FEATURES

(75) Inventors: Masakazu Suzuki, Yokkaichi (JP); Toshikazu Sakurai, Yokkaichi (JP); Yuji Minoda, Wako (JP); Yohei Kugumiya, Wako (JP); Kazuyuki Iwashita, Wako (JP)

(73) Assignees: Sumitomo Wiring Systems, Ltd. (JP); Honda Motor Co., Ltd. (JP)

( * ) Notice: Subject to any disclaimer, the term of this patent is extended or adjusted under 35 U.S.C. 154(b) by 257 days.

(21) Appl. No.: 13/036,131

(22) Filed: Feb. 28, 2011

(65) Prior Publication Data

US 2011/0212654 A1 Sep. 1, 2011

(30) Foreign Application Priority Data

Mar. 1, 2010 (JP) ..... 2010-044193

(51) Int. Cl.
*H01R 13/40* (2006.01)

(52) U.S. Cl. ..... 439/752.5

(58) Field of Classification Search ..... 439/752.5
See application file for complete search history.

(56) References Cited

U.S. PATENT DOCUMENTS

| | | | | |
|---|---|---|---|---|
| 2,089,844 | A * | 8/1937 | Anderson Alf E | 439/680 |
| 3,566,334 | A * | 2/1971 | Zeigler | 439/248 |
| 3,980,385 | A * | 9/1976 | Hirokawa et al. | 439/748 |
| 4,124,264 | A * | 11/1978 | Kato et al. | 439/595 |
| 4,374,604 | A * | 2/1983 | Hemmer et al. | 439/587 |
| 4,894,027 | A * | 1/1990 | Brantingham et al. | 439/699.2 |
| 4,902,251 | A * | 2/1990 | Grzena | 439/699.2 |
| 4,963,102 | A * | 10/1990 | Gettig et al. | 439/291 |
| 5,002,504 | A * | 3/1991 | Carlson | 439/599 |
| 5,035,654 | A * | 7/1991 | Endo | 439/679 |
| 5,080,604 | A * | 1/1992 | Rider et al. | 439/357 |
| 5,190,477 | A * | 3/1993 | Akeda | 439/595 |
| 5,226,839 | A * | 7/1993 | Koumatsu et al. | 439/595 |
| 5,238,411 | A * | 8/1993 | Jinno et al. | 439/59 |
| 5,253,316 | A * | 10/1993 | Shibutani et al. | 385/78 |
| 5,626,499 | A * | 5/1997 | Yagi et al. | 439/752.5 |
| 5,653,613 | A * | 8/1997 | Shimoda | 439/752 |
| 5,743,770 | A * | 4/1998 | Hamai | 439/752.5 |
| 6,227,915 | B1 * | 5/2001 | Sakatani et al. | 439/852 |
| 6,283,794 | B1 * | 9/2001 | Osuga | 439/620.05 |
| 6,390,860 | B2 * | 5/2002 | Shirouzu et al. | 439/752.5 |
| 6,589,080 | B2 * | 7/2003 | Tanaka | 439/595 |
| 6,679,739 | B2 * | 1/2004 | Fujita | 439/862 |

(Continued)

FOREIGN PATENT DOCUMENTS

JP 2007-26756 2/2007

*Primary Examiner* — Neil Abrams
(74) *Attorney, Agent, or Firm* — Gerald E. Hespos; Michael J. Porco; Matthew T. Hespos

(57) ABSTRACT

A connector includes: a terminal fitting having a body portion; and a housing having a cavity that receives the terminal fitting, wherein the body portion has a first protrusion that protrudes from an outer surface of the body portion and an interference avoiding portion, wherein the first protrusion and the interference avoiding portion are disposed to be opposed to each other substantially in a diagonal line on a virtual projection plane, and wherein the cavity is formed with, in an inner surface thereof, a first groove into which the first protrusion is allowed to enter only when the terminal fitting has a proper insertion posture relative to the cavity and an interference portion that is formed to swell from the inner surface of the cavity to narrow a gap with the interference avoiding portion.

5 Claims, 8 Drawing Sheets

U.S. PATENT DOCUMENTS 6,905,376 B2 * 6/2005 Chen ..... 439/852
6,979,235 B2 * 12/2005 Lappöhn ..... 439/733.1
7,101,233 B2 * 9/2006 Maeda ..... 439/852
7,108,430 B2 * 9/2006 Finona et al. ..... 385/75
7,112,105 B2 * 9/2006 Wu ..... 439/752.5
7,147,522 B2 * 12/2006 Kobayashi et al. ..... 439/852
7,198,525 B2 * 4/2007 Nagamine et al. ..... 439/843
7,232,339 B1 * 6/2007 Wilson et al. ..... 439/595
7,275,969 B2 * 10/2007 Fukaya et al. ..... 439/851
7,281,961 B1 10/2007 Sugiyama et al.
7,311,561 B2 * 12/2007 Anbo et al. ..... 439/752.5
7,371,132 B2 * 5/2008 Tanaka ..... 439/752.5
7,377,820 B2 * 5/2008 Osada et al. ..... 439/680
2005/0191912 A1 9/2005 Maeda
2006/0138637 A1 6/2006 Nagamine et al.
2010/0317212 A1 * 12/2010 Daily ..... 439/230

* cited by examiner

ELECTRICAL CONNECTOR WITH TERMINAL ORIENTATION FEATURES

CROSS-REFERENCE TO THE RELATED APPLICATION

The present application is based upon and claims priority from prior Japanese Patent Application No. 2010-044193, filed on Mar. 1, 2010, the entire contents of which are incorporated herein by reference.

BACKGROUND OF THE INVENTION

1. Field of the Invention

The present invention relates to a connector.

2. Description of the Related Art

Conventionally, there is a connector provided with a measure for preventing wrong insertion of a terminal fitting. An example of such connector is disclosed in JP-A-2007-026756. In the connector, the terminal fitting is inserted into a cavity in a housing. A stabilizer is formed on an outer circumference of a square tube portion of the terminal fitting so as to protrude like a plate in a direction crossing an insertion direction of the terminal fitting. A first groove corresponding to the stabilizer is formed in an inner wall of the cavity.

When the terminal fitting is intended to be inserted in a regular posture, the stabilizer enters the first groove. Thus, the terminal fitting is inserted into the cavity without trouble. On the other hand, when the terminal fitting is intended to be inserted into the cavity in an irregular posture in which the terminal fitting is tilted around an axis parallel to the insertion direction, the stabilizer interferes with an opening edge portion of the cavity. Thus, the terminal fitting is prevented from being inserted in the irregular posture.

In recent years, there has been a request to reduce the size of terminal fittings. When the size of the terminal fitting is reduced, the protruding distance of a stabilizer is also reduced correspondingly. On the other hand, a clearance to backup a smooth insertion operation of the terminal fitting must be secured between an outer surface of the terminal fitting and an inner surface of a cavity. However, manufacturing cost is increased due to high dimensional precision required to narrow the clearance. Therefore, the clearance has to be secured to some extent in spite of the advanced miniaturization of the terminal fitting.

Thus, the protruding distance of the stabilizer which has been miniaturized with the miniaturization of the terminal fitting substantially becomes as large as the clearance. As a result, the wrong insertion preventing function of the stabilizer may not be effectively exerted although the posture of the terminal fitting is irregular so that the terminal fitting in the irregular posture is allowed to be inserted as it is.

SUMMARY OF THE INVENTION

One of objects of the present invention is to provide a connector capable of surely preventing a terminal fitting in an improper posture from being inserted into a cavity by mistake even when the terminal fitting is miniaturized.

According to a first configuration, there is provided a connector including: a terminal fitting having a body portion having substantially square tube shape; and a housing having a cavity that receives the terminal fitting when the terminal fitting is inserted into the cavity, wherein the body portion has a first protrusion that protrudes from an outer surface of the body portion and an interference avoiding portion that is dented from the outer surface of the body portion, wherein the first protrusion and the interference avoiding portion are disposed to be opposed to each other substantially in a diagonal line on a virtual projection plane where the first protrusion and the interference avoiding portion are projected in a direction in which the terminal fitting is inserted into the cavity, and wherein the cavity is formed with, in an inner surface thereof, a first groove into which the first protrusion is allowed to enter only when the terminal fitting has a proper insertion posture relative to the cavity and an interference portion that is formed to swell from the inner surface of the cavity to narrow a gap with the interference avoiding portion.

According to a second configuration, there is provided a connector described in the first configuration, wherein the body portion is formed by a plurality of wall portions, and wherein a boundary portion between adjacent two of the wall portions that are adjacent to each other substantially at right angles is dented to form the interference avoiding portion to have substantially quarter arc shape.

According to a third configuration, there is provided a connector described in the first configuration, wherein the first protrusion is configured by a embossed protrusion formed on a wall portion of the body portion.

According to a fourth configuration, there is provided a connector described in the first configuration, wherein a second protrusion is formed in the body portion so that the second protrusion protrudes in a different position of the outer surface of the body portion from the first protrusion and the interference avoiding portion on the virtual projection plane, and wherein a second groove that allows the second protrusion to be entered only when the terminal fitting has a proper insertion posture relative to the cavity is formed in the inner surface of the cavity.

According to a fifth configuration, there is provided a connector described in the fourth configuration, wherein the second protrusion is formed in a wall portion that is opposed substantially in parallel to the wall portion where the first protrusion is formed, and wherein the second protrusion is positioned in an opposite edge portion to the interference avoiding portion in a width direction of the wall portion.

According to the thus configured connector, when the terminal fitting is intended to be inserted in an improper posture in which the terminal fitting is inverted around a symmetric axis parallel to the insertion direction, a portion of the body portion which is located on the diagonally opposite side to the interference avoiding portion is locked in abutment against an area of the opening edge portion of the cavity corresponding to the interference portion, while the first protrusion is locked in abutment against an area of the opening edge portion of the cavity located on the opposite side to the cavity with interposition of the interference portion. Due to the lock operations, insertion of the terminal fitting in the improper posture is prevented.

The lock width between the opening edge portion of the cavity and the terminal fitting is increased correspondingly to the area where a part of the body portion and the interference portion are locked in each other, as compared with a connector in which only a first protrusion protruding from a body is locked in an opening edge portion of a cavity. It is therefore possible to surely prevent the terminal fitting from being inserted in an improper posture by mistake even if the protruding distance of the first protrusion is reduced due to the miniaturization of the terminal fitting.

The boundary portion between two wall portions which are adjacent to each other substantially at right angles in the body portion is dented to form the interference avoiding portion substantially like a quarter arc. Accordingly, the shape of the external surface of the body portion can be simplified, as compared with a configuration in which only one of the wall portions forming the body portion is dented.

A wall portion formed as a constituent member of the body portion is partially hammered out to form the first protrusion protruding like an emboss. Accordingly, the first protrusion is hardly deformed, as compared with a configuration in which a wall portion formed as a constituent member of a body portion is cut and raised to form a first protrusion protruding like a plate.

When the terminal fitting is intended to be inserted in an improper posture in which the terminal fitting is inverted, the second protrusion is locked in abutment against another area of the opening edge portion of the cavity than the areas where the interference portion and the first protrusion are locked. Accordingly, the lock width between the opening edge portion of the cavity and the terminal fitting is expanded correspondingly to the second protrusion.

The second protrusion is positioned in an opposite edge portion to the interference avoiding portion in the width direction of the wall portion. Due to the layout in which the first protrusion and the interference avoiding portion are disposed diagonally, the first protrusion and the second protrusion have a corresponding positional relation to be slanted on the same side in the width direction and protrude from the body portion in opposite directions to each other. Thus, the lock width between the opening edge portion of the cavity and the terminal fitting is expanded in directions parallel to the protrusion directions of the first protrusion and the second protrusion.

A general configuration that implements the various features of the present invention will be described with reference to the drawings. The drawings and the associated descriptions are provided to illustrate embodiments of the invention and not to limit the scope of the invention.

DETAILED DESCRIPTION OF THE PREFERRED EMBODIMENTS

Figure 1:
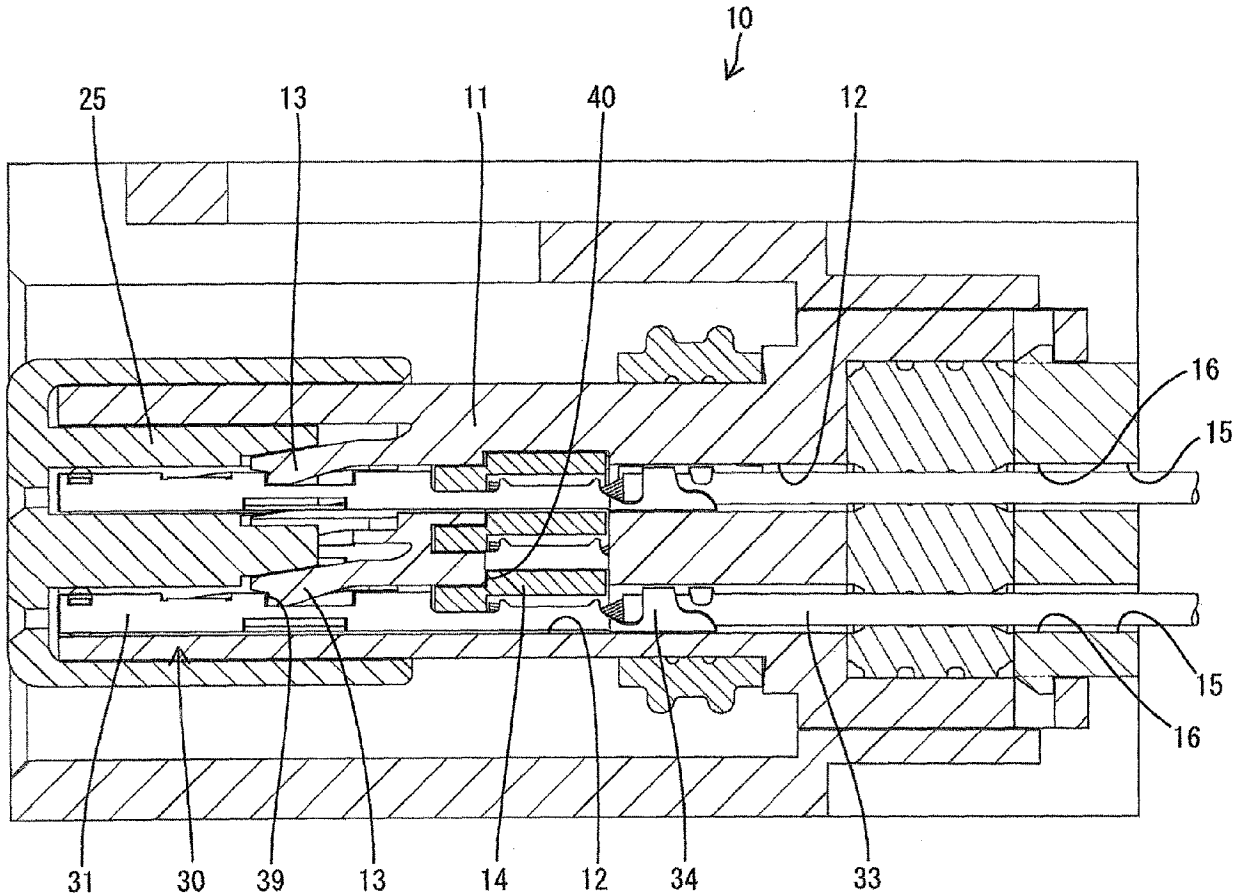
FIG. 1 is a sectional view of a connector according to a first embodiment.

A first embodiment which embodies the invention will be described below with reference to FIGS. 1 to 8. A connector according to the embodiment is configured by a housing 10 made of synthetic resin and a plurality of terminal fittings 30 inserted into the housing 10.

The housing 10 has a housing body 11, front holders 25 and retainers 14. The front holders 25 are built in the housing body 11 to form front end portions of cavities 12. The cavities 12 are formed in the housing body 11 so as to penetrate the housing body 11 in a front/rear direction. A lance 13 is formed in each cavity 12 so as to extend like a cantilever frontward along an inner wall surface of the cavity 12. The retainer 14 can be placed at the rear of the lance 13.

Terminal insertion ports 15 at rear ends of the cavities 12 are opened in aback surface of the housing 10 so that the terminal fittings 30 can be inserted into the cavities 12 through the terminal insertion ports 15 respectively. The opening shape of each terminal insertion port 15 and the sectional shape of a terminal insertion portion 16 of the cavity 12 communicating with the terminal insertion port 15 are formed to match with the external shape of a front end portion of each terminal fitting 30 which will be described later, that is, a front end portion of a body portion 31, and a first protrusion 42 and a second protrusion 43 which are formed to protrude in the front end portion of the body portion 31. In addition, a first groove 17 corresponding to the first protrusion 42 and a second groove 18 corresponding to the second protrusion 43 are formed in an inner surface of the rear end portion of each cavity 12 so as to extend in the front/rear direction (which is a direction parallel to the direction in which a not-shown tab, which has a well-known configuration, should be inserted/detached into/from the cavity 12).

Figure 2:
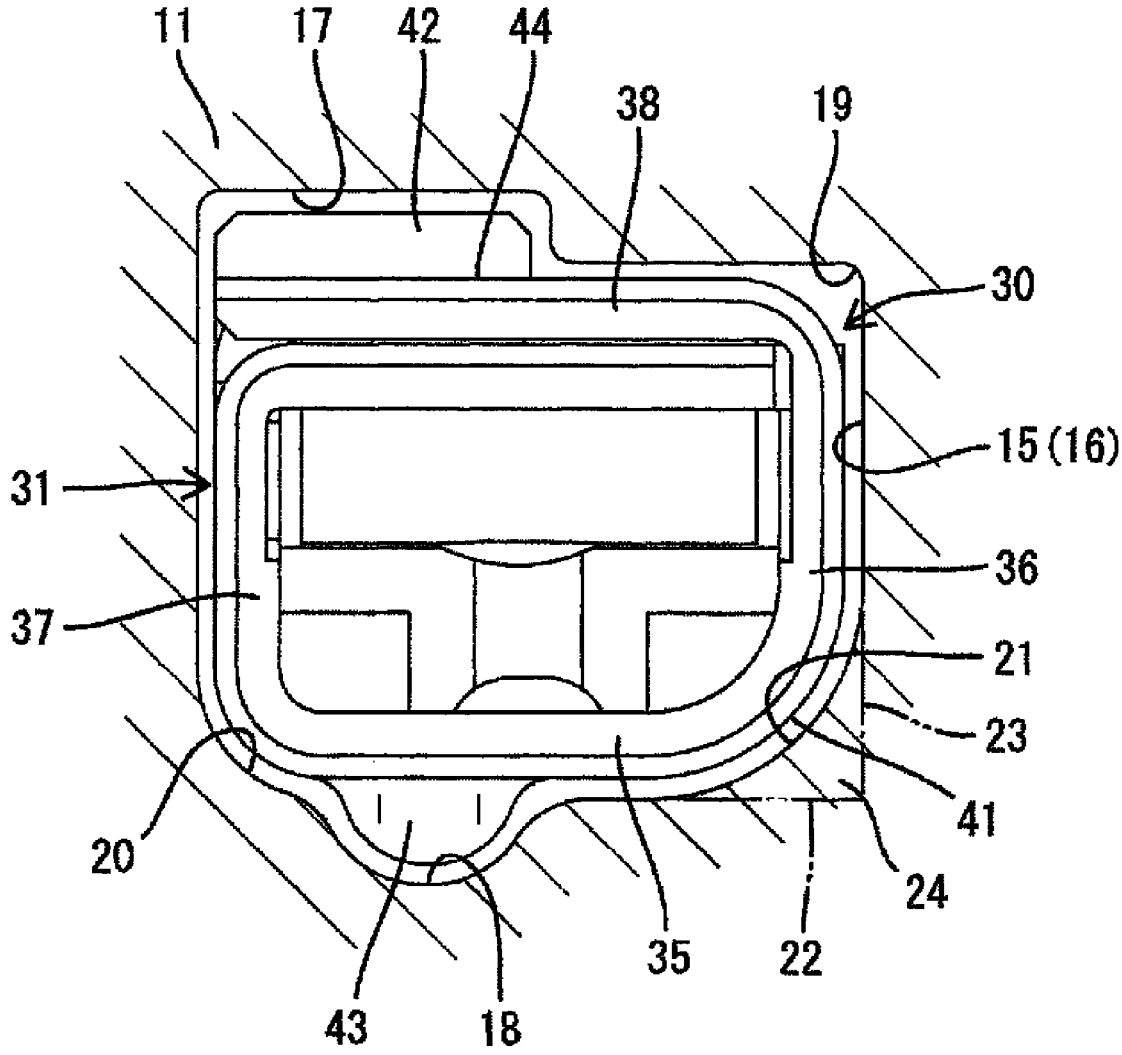
FIG. 2 is a sectional view showing a state in which a terminal fitting with a proper posture enters a terminal insertion port.
Figure 3:
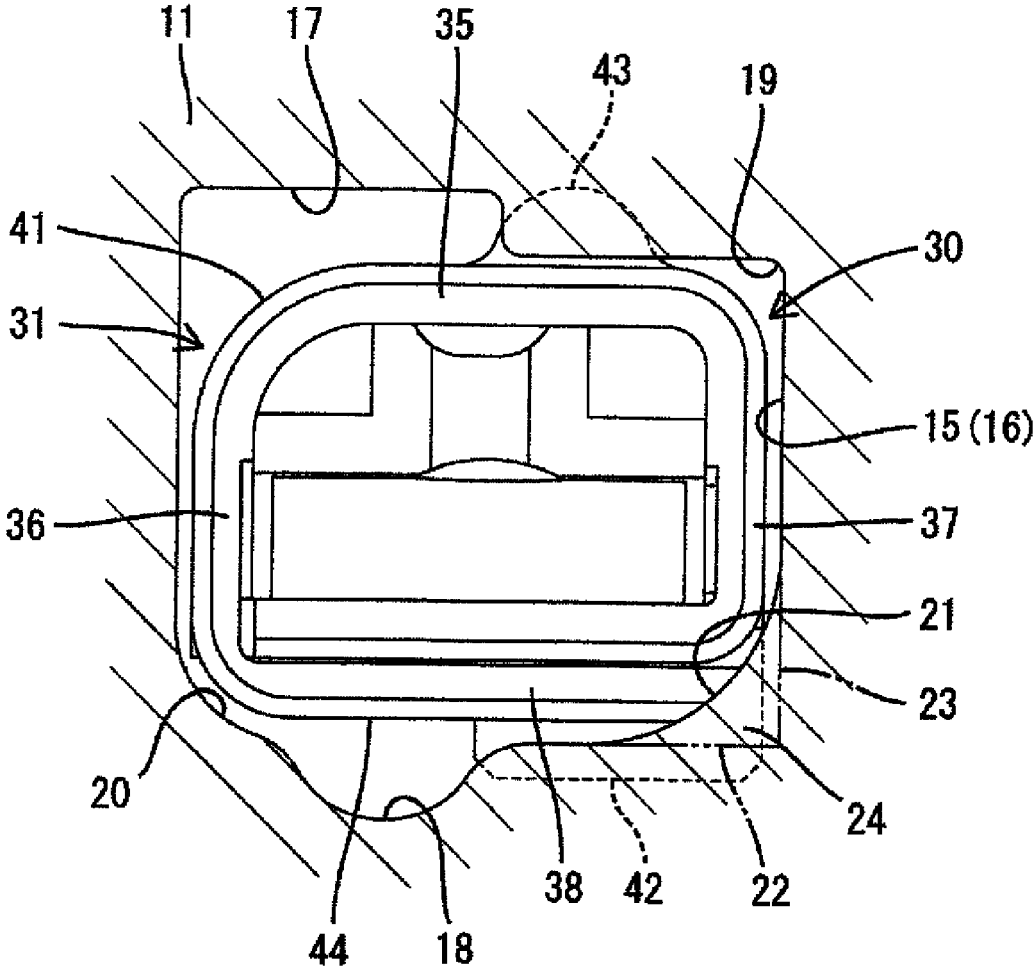
FIG. 3 is a sectional view showing a state in which the terminal fitting with an improper posture intends to enter the terminal insertion port.

FIGS. 2 and 3 are views in which a section cutting the terminal insertion portion 16 perpendicularly to an insertion direction of the terminal fitting 30 is viewed from the front. FIGS. 2 and 3 show a virtual projection plane on which the terminal insertion portion 16 is projected in the direction in which the terminal fitting 30 should be inserted into the cavity 12. In addition, a front surface of the terminal fitting 30 appears in FIGS. 2 and 3. Thus, a left/right direction in FIGS. 2 and 3 is reversed to that in the description of the embodiment.

The sectional shape of the terminal insertion portion 16 (the opening shape of the terminal insertion port 15) is formed wholly like a substantially rectangular shape corresponding to the body portion 31 of the terminal fitting 30, but is not symmetrical with respect to a point and with respect to a virtual axis which is parallel to the insertion direction of the terminal fitting 30. That is, in the sectional shape, a corner portion connecting a top surface with a left side surface (a right side edge in FIGS. 2 and 3) is formed as a small quarter arc surface 19 which has a small curvature radius, and a corner portion connecting a right side surface with a bottom surface is formed as a middle quarter arc surface 20 which has a larger curvature radius than the small quarter arc surface 19.

On the other hand, a lower end portion of the left side surface and a left end portion of the bottom surface are connected with each other through a large quarter arc surface 21 which has a larger curvature radius than the middle quarter arc surface 20. In the sectional shape of the terminal insertion portion 16, an interference portion 24 is formed as a portion surrounded by the large quarter arc surface 21, a virtual surface 22 extending leftward straightly from the bottom surface, and a virtual surface 23 extending downward straightly from the left side surface.

In addition, the first groove 17 has a sectional shape substantially like a rectangle long from side to side, and is located to dent a right end portion in the top surface 19 of the terminal insertion portion 16. The right side surface of the first groove 17 is connected to the right side surface of the terminal insertion portion 16 on the same plane. In addition, the width of the first groove 17 in the left/right direction is substantially half as large as the whole width of the terminal insertion portion 16. The second groove 18 substantially has a semicircular sectional shape, and is disposed to dent the vicinity of the right end portion in the bottom surface of the terminal insertion portion 16. An area where the second groove 18 is formed in the left/right direction is put within a right half range of the whole width of the terminal insertion portion 16.

The first groove 17 and the interference portion 24 are disposed substantially on a diagonal line. The first groove 17 and the second groove 18 are disposed substantially in the same position in the left/right direction. In addition, the first groove 17 and the second groove 18 are disposed in opposite positions to each other in an up/down direction, that is, in different sides of the inner surface of the terminal insertion portion 16.

Each terminal fitting 30 in the embodiment is a female terminal which is wholly long in the front/rear direction (in a direction parallel to a direction in which the terminal should be connected to a male partner terminal). A front end-side portion of the terminal fitting 30 is formed as a body portion 31 substantially like a square tube, which receives an elastic contact piece 32 internally. A rear end-side portion of the terminal fitting 30 is formed as an electric cable connection portion 34 like an open barrel, to which an electric cable 33 should be connected by pressure bonding.

The body portion 31 is formed like a square tube out of a plurality of wall portions connected through their creases in the front/rear direction. The wall portions include a bottom wall 35, opposite (left and right) side walls 36 and 37, and a top wall 38 divided into three in the front/rear direction. The electric contact piece 32 is received in the body portion 31 so that the elastic contact piece 32 can make an elastic contact with a tab inserted into the body portion 31.

A lock hole 39 is formed in the body portion 31 so as to be opened in the outer surface (the top surface) of the body portion 31. When the terminal fitting 30 is inserted into the cavity 12 of the housing 10, the lance 13 is locked in the lock hole 39 to prevent the terminal fitting 30 from being pulled out. In addition, a rear edge of the body portion 31 is formed as a lock edge portion 40. In the state where the terminal fitting 30 has been inserted into the cavity 12, the retainer 14 built in the housing 10 is locked in the lock edge portion 40. Due to the lock operation, the terminal fitting 30 is prevented from being pulled out. That is, due to the double lock operations of the lance 13 and the retainer 14, the terminal fitting 30 is surely prevented from being pulled out.

An interference avoiding portion 41, the first protrusion 42 and the second protrusion 43 are formed as wrong insertion preventing units which cooperate with the interference portion 24, the first groove 17 and the second groove 18 in the cavity 12 so as to prevent the terminal fitting 30 from being inserted into the cavity 12 upside down (that is, inversely in the left/right direction).

The interference avoiding portion 41 has a configuration in which a boundary portion between the left side wall 36 and the bottom wall 35 adjacent to each other substantially at right angles in the wall portions forming the body portion 31 is dented (connected) substantially like a quarter arc shape. The curvature radius of an arc wall forming the interference avoiding portion 41 is made larger than the curvature radius of any one of an arc surface connecting the bottom wall 35 and the right side wall 37, an arc surface connecting the right side wall 37 and the top wall 38, and an arc surface connecting the top wall 38 and the left side wall 36. Due to the differences among the curvature radii, the crease of the interference avoiding portion 41 among the four creases forming the body portion 31 dents the outer surface of the body portion 31 as compared with the other creases.

Figure 4:
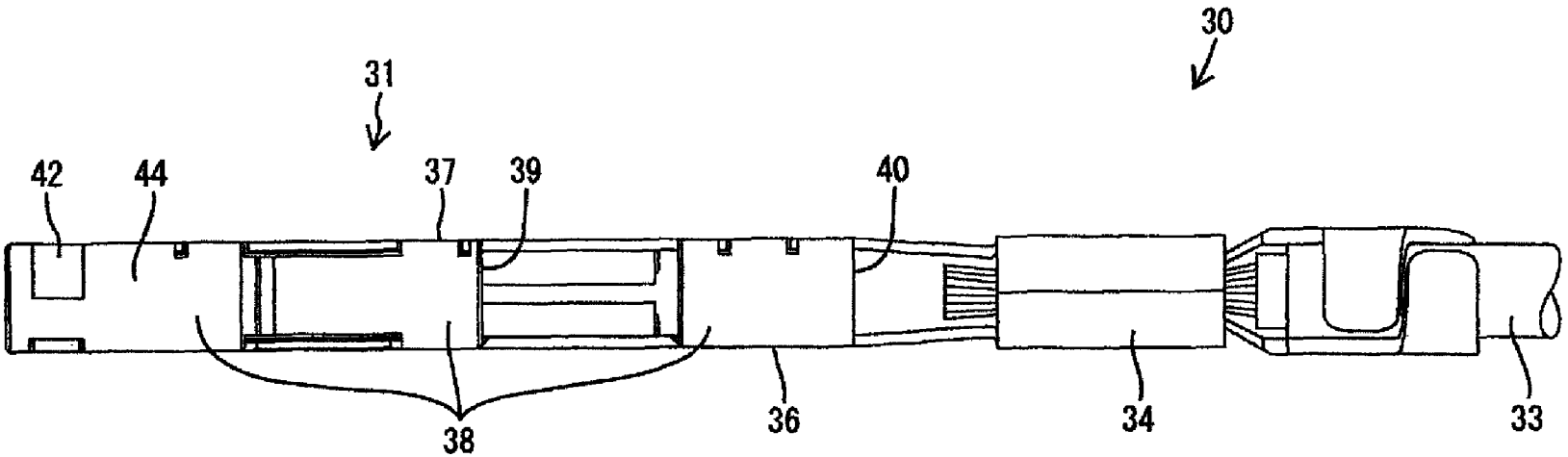
FIG. 4 is a plan view of the terminal fitting.
Figure 5:
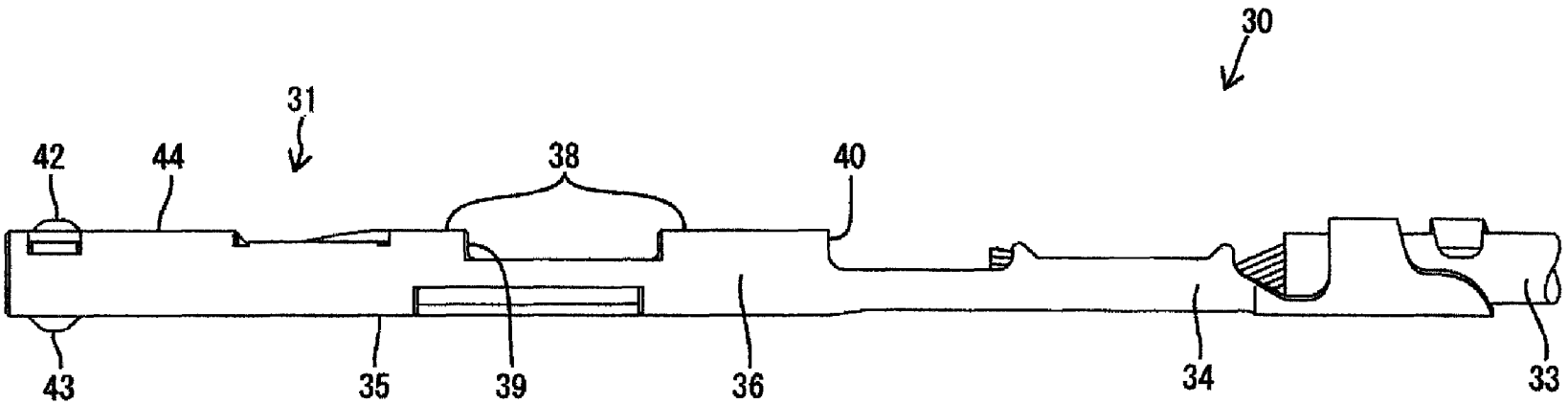
FIG. 5 is a left side view of the terminal fitting.

Of the wall portions forming the body portion 31, a front wall 44 which is a part of the top wall 38 is partially hammered out toward the outer surface (upward) so as to form the first protrusion 42 like an emboss. The first protrusion 42 has a rectangular shape long from side to side in front view as shown in FIGS. 2 and 3, substantially an arc shape in side view as shown in FIG. 5, and substantially a square shape in top view as shown in FIG. 4. The first protrusion 42 is disposed in a position close to a front end of the front wall 44 (the body portion 31) in the front/rear direction (the direction in which the terminal fitting should be inserted/detached into/from the cavity 12). In addition, the first protrusion 42 occupies substantially a right half area of the front wall 44 (the body portion 31) in the left/right direction, and the width of the first protrusion 42 is substantially half as large as the whole width of the body portion 31.

Figure 6:
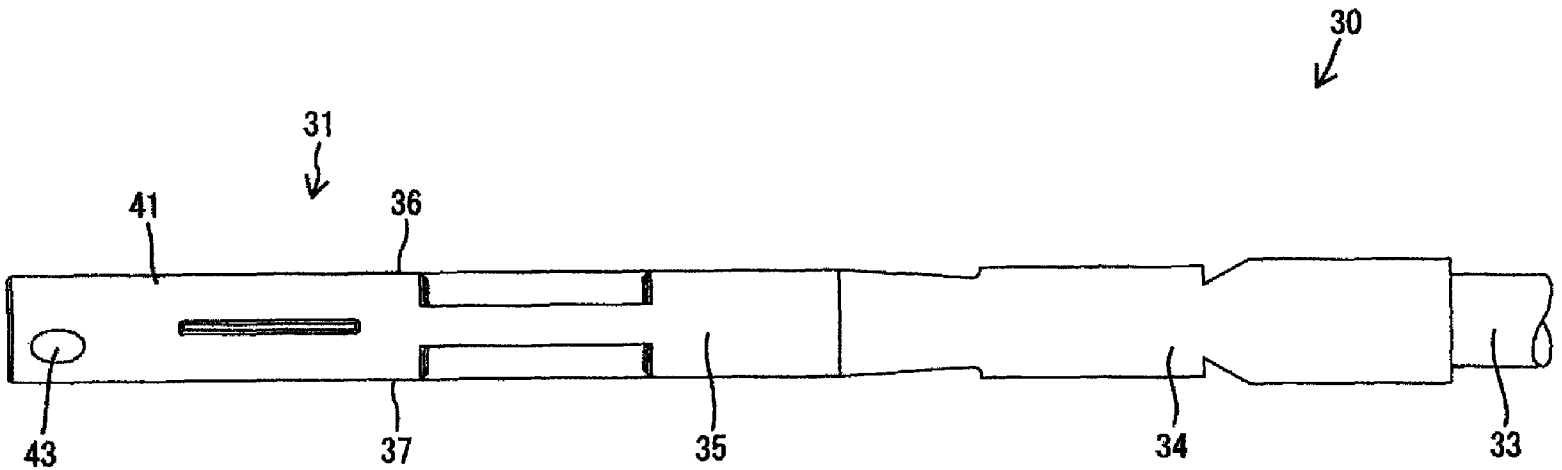
FIG. 6 is a bottom view of the terminal fitting.
Figure 7:
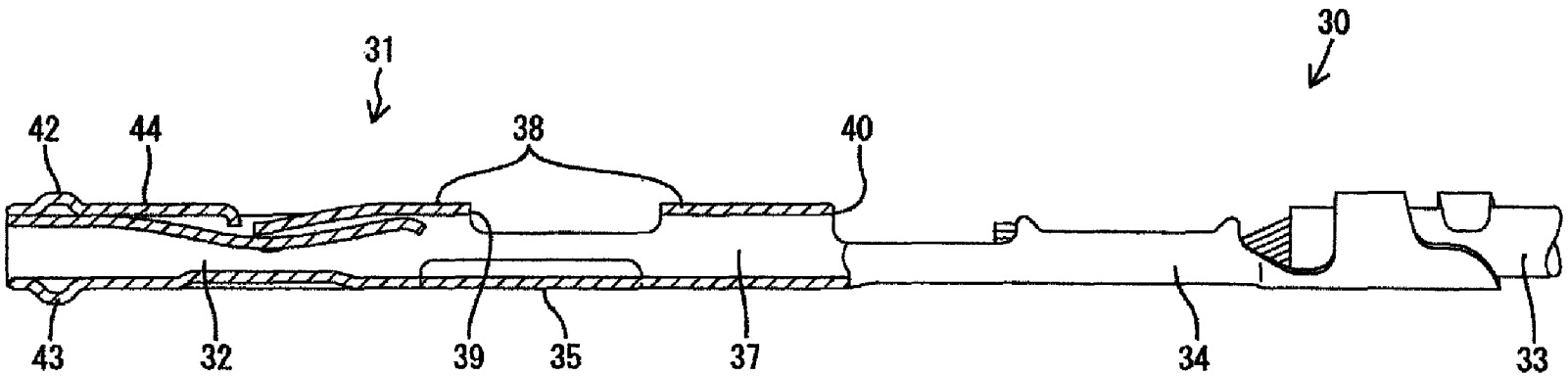
FIG. 7 is a sectional view of the terminal fitting.
Figure 8:
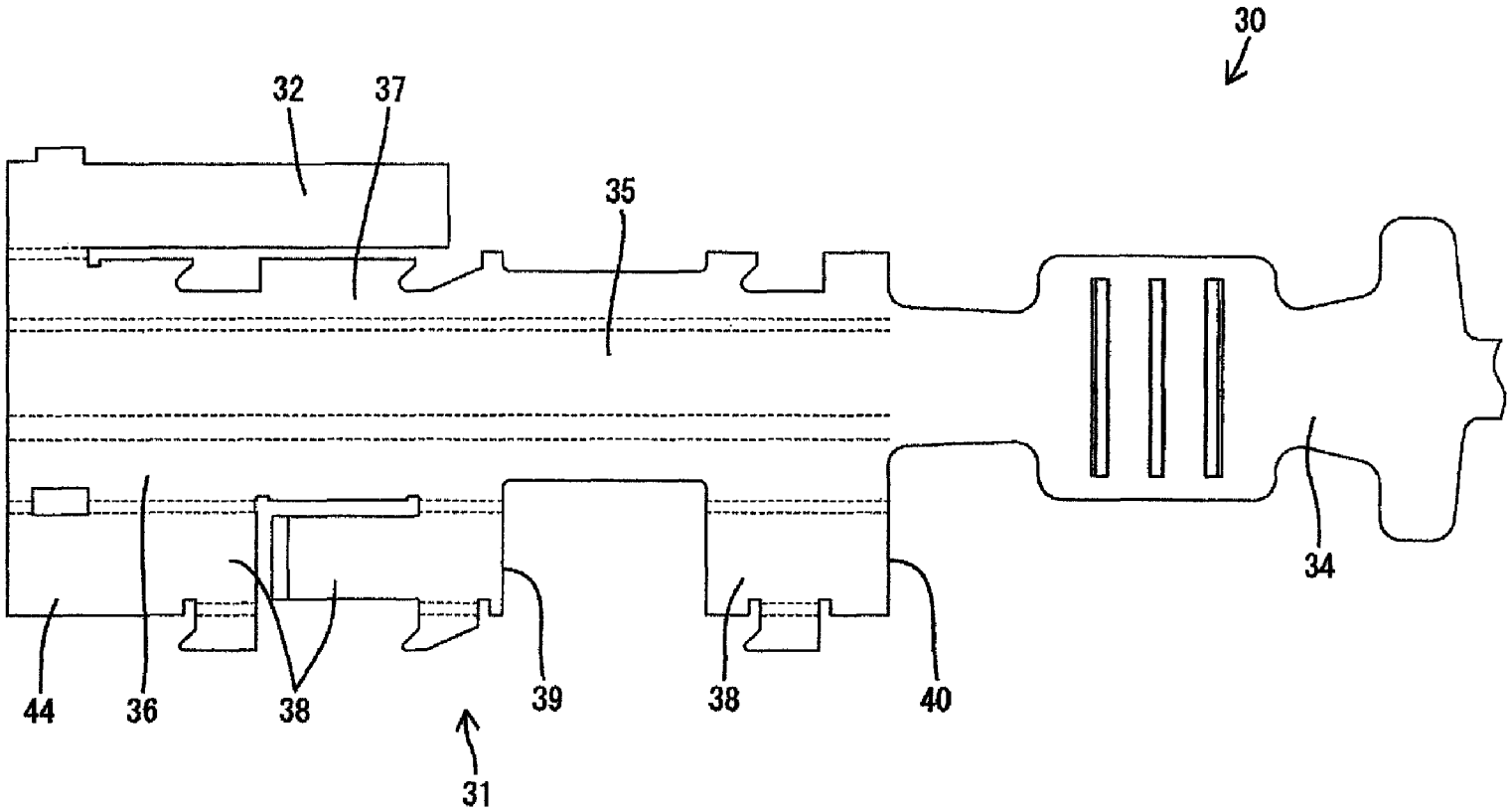
FIG. 8 is a development view of the terminal fitting.

The bottom wall 35 (that is, the wall portion opposed substantially in parallel to the top wall 38 where the first protrusion 42 is formed) of the wall portions forming the body portion 31 is partially hammered out toward the outer surface (downward) so as to form the second protrusion 43 like an emboss. The second protrusion 43 has substantially a half arc shape in front view as shown in FIGS. 2 and 3, substantially a trapezoidal shape in side view as shown in FIG. 5, and substantially an elliptic shape in bottom view as shown in FIG. 6. The second protrusion 43 is disposed in a position close to a front end of the bottom wall 35 (the body portion 31) in the front/rear direction. In addition, the second protrusion 43 is put within a right half range of the whole width of the bottom wall 35 (the body portion 31) in the left/right direction. That is, the second protrusion 43 is disposed in another position than the first protrusion 42 and the interference avoiding portion 41.

As described above, the interference avoiding portion 41 is disposed in a left lower corner portion, and the first protrusion 42 is disposed near a right upper corner portion. Thus, there is a layout in which the interference avoiding portion 41 and the first protrusion 42 are disposed substantially on a diagonal line. In addition, the second protrusion 43 is disposed substantially on the same position as the first protrusion 42 in the left/right direction, but in an opposite position to the interference avoiding portion 41 in the left/right direction. In the same manner, the first protrusion 42 and the second protrusion 43 are disposed in opposite positions to each other in the up/down direction, that is, on different ones (the top wall 38 and the bottom wall 35) of the wall portions forming the body portion 31.

In the connector according to the embodiment, as described above, the first protrusion 42 formed to protrude from the outer surface of the body portion 31 of the terminal fitting 30 and the interference avoiding portion 41 formed to dent the outer surface of the body portion 31 are formed in the body portion 31. The first protrusion 42 and the interference avoiding portion 41 are disposed to be opposed to each other substantially diagonally on a virtual projection plane (see FIGS. 2 and 3) where the first protrusion 42 and the interference avoiding portion 41 are projected in the direction in which the terminal fitting 30 should be inserted into the cavity 12. In addition, the first groove 17 which the first protrusion 42 is allowed to enter only when the insertion posture of the terminal fitting 30 into the cavity 12 is proper, and the interference portion 24 which swells to narrow a gap with the interference avoiding portion 41 are formed in an inner surface of the cavity 12. According to this configuration, when the terminal fitting 30 in a proper posture is intended to be inserted into the cavity 12, the first protrusion 42 enters the first groove 17, and the interference avoiding portion 41 faces the interference portion 24 without interference, as shown in FIG. 2. Thus, in this state, the terminal fitting 30 can be inserted without trouble.

On the other hand, when the terminal fitting 30 is intended to be inserted with an improper posture in which the terminal fitting 30 is inverted around a symmetry axis parallel to the insertion direction, a portion of the body portion 31 (a corner portion connected with the first protrusion 42) located on the diagonally opposite side to the interference avoiding portion 41 is locked in abutment against an area of an opening edge portion of the terminal insertion port 15 of the cavity 12 corresponding the interference portion 24, and the first protrusion 42 is locked in abutment against an area (a portion under the interference portion 24) of the opening edge portion of the terminal insertion port 15 vertically opposite to the cavity 12 (the terminal insertion portion 16) with interposition of the interference portion 24, as shown in FIG. 3. Due to those lock operations, the terminal fitting 30 can be prevented from being inserted in an improper posture.

In the embodiment, portions of the terminal fitting 30 to be locked in the opening edge portion of the cavity 12 for preventing the terminal fitting 30 from being inserted in an improper posture are not only the first protrusion 42 but also a part of the body portion 31 (that is, a portion of the body portion 31 located on the diagonally opposite side to the interference avoiding portion 41). According to the embodiment, therefore, the lock width between the opening edge portion of the cavity 12 and the terminal fitting 30 is increased correspondingly to areas where a part of the body portion 31 and the interference portion 24 are locked, as compared with a configuration in which only the first protrusion protruding from the body portion is located in the opening edge portion of the cavity. Thus, even if the protruding distance of the first protrusion 42 is reduced due to the miniaturization of the terminal fitting 30, the terminal fitting 30 in an improper posture can be surely prevented from being erroneously inserted.

In addition, the second protrusion 43 protruding from another position of the outer surface of the body portion 31 on a virtual projection plane than the first protrusion 42 and the interference avoiding portion 41 is formed in the body portion 31, while the second groove 18 which the second protrusion 43 is allowed to enter only when the insertion posture of the terminal fitting 30 into the cavity 12 is proper is formed in the inner surface of the cavity 12. According to this configuration, when the terminal fitting 30 is intended to be inserted in an improper posture in which the terminal fitting 30 is inverted, the second protrusion 43 is locked in abutment against another area of the opening edge portion of the cavity 12 (a portion of the opening edge of the terminal insertion port 15 adjacent to the first groove 17) than the lock areas with the interference portion 24 and the first protrusion 42. Thus, the lock width between the opening edge portion of the cavity 12 and the terminal fitting 30 is expanded correspondingly to the second protrusion 43. Thus, it is possible to more surely prevent the terminal fitting 30 from being inserted in the improper posture.

Further, the second protrusion 43 is formed in the bottom wall 35 which is opposed substantially in parallel to the top wall 38 in which the first protrusion 42 is formed among the wall portions forming the body portion 31, and the second protrusion 43 is placed in an opposite edge portion to the interference avoiding portion 41 in the width direction of the bottom wall 35. Due to the first protrusion 42 and the interference avoiding portion 41 disposed diagonally, the first protrusion 42 and the second protrusion 43 have a corresponding positional relation to be slanted on the same side (the right side) in the width direction and protrude in vertically opposite directions to each other from the body portion 31. Thus, when the terminal fitting 30 is intended to be inserted in an improper posture in which the terminal fitting 30 is inverted, the lock width of the first protrusion 42 and the lock width of the second protrusion 43 are secured on the opposite sides to each other with interposition of the body portion 31. In addition, there is no fear that the first protrusion 42 is located correspondingly to the second groove 18, and there is no fear that the second protrusion 43 is located correspondingly to the first groove 17. Thus, the lock width between the opening edge portion of the cavity 12 and the terminal fitting 30 is expanded in a direction parallel to the protrusion directions of the first protrusion 42 and the second protrusion 43.

In addition, of the wall portions forming the body portion 31, the boundary portion between the left side wall 36 and the bottom wall 35 which are adjacent to each other substantially at right angles is dented substantially like a quarter arc shape to form the interference avoiding portion 41. Accordingly, the shape of the outer surface of the body portion 31 is simplified as compared with a configuration in which only one of the wall portions forming the body portion 31 is dented.

In addition, the top wall 38 formed a constituent member of the body portion 31 is partially hammered out to form the first protrusion 42 protruding like an emboss. Thus, the first protrusion 42 is hardly deformed as compared with a configuration in which a wall portion formed as a constituent member of a body portion is cut and raised as a first protrusion protruding like a plate.

The connector according to the embodiment of the present invention is not limited to the configuration described in the aforementioned description and with reference to the drawings. For example, the following modifications to the embodiment may also be available.

(1) Although the first protrusion is disposed in the front end portion of the terminal fitting in the aforementioned embodiment, the first protrusion may be disposed at the rear of the front end portion of the terminal fitting.

(2) Although a wall portion formed as a constituent member of the body portion is partially hammered out to form the first protrusion protruding like an emboss in the aforementioned embodiment, the wall portion formed as a constituent member of the body portion may be cut and raised to form the first protrusion protruding like a plate.

(3) Although the area where the first protrusion is formed is limited within one of the wall portions forming the body portion in the aforementioned embodiment, the first protrusion may be formed to be as long as two of the wall portions forming the body portion.

(4) Although a boundary portion between two wall portions adjacent to each other substantially at right angles in the body portion is dented to form the interference avoiding portion substantially like a quarter arc in the aforementioned embodiment, only one of the wall portions forming the body portion may be dented to form the interference avoiding portion.

(5) Although the second protrusion is provided as another wrong insertion preventing unit than the first protrusion and the interference avoiding portion in the aforementioned embodiment, wrong insertion may be prevented only by the first protrusion and a recess portion disposed diagonally, without providing the second protrusion.

(6) Although the second protrusion is disposed in the front end portion of the terminal fitting (the body portion) in the aforementioned embodiment, the second protrusion may be disposed at the rear of the front end portion of the terminal fitting.

(7) Although the second protrusion is formed in another wall portion which is opposed substantially in parallel to the wall portion where the first protrusion is formed in the aforementioned embodiment, the second protrusion may be formed in another wall portion connected substantially at right angles to the wall portion where the first protrusion is formed.

(8) Although a wall portion formed as a constituent member of the body portion is partially hammered out to form the second protrusion like an emboss in the aforementioned embodiment, the wall portion formed as a constituent member of the body portion may be cut and raised to form the second protrusion protruding like a plate.

(9) Although the area where the second protrusion is formed is limited within one of the wall portions forming the body portion in the aforementioned embodiment, the second protrusion may be formed to be as long as two of the wall portions forming the body portion.

(10) Although the aforementioned embodiment has been described in the case where the invention is applied to a female terminal fitting in which a tab should be inserted into a body portion substantially shaped like a square tube, the invention is also applicable to a male terminal fitting with a tab which should be inserted into a body portion of a female terminal fitting. In this case, it will go well if a body portion substantially shaped like a square tube is provided to be connected to a rear end of the tab, and a first protrusion and a recess portion are formed in the body portion.

Although the embodiments according to the present invention have been described above, the present invention may not be limited to the above-mentioned embodiments but can be variously modified. Components disclosed in the aforementioned embodiments may be combined suitably to form various modifications. For example, some of all components disclosed in the embodiments may be removed or may be appropriately combined.

Additional advantages and modifications will readily occur to those skilled in the art. Therefore, the invention in its broader aspects may not be limited to the specific details and representative embodiments shown and described herein. Accordingly, various modifications may be made without departing from the spirit or scope of the general inventive concept as defined by the appended claims and their equivalents.

What is claimed is:

1. A connector comprising:

a terminal fitting comprising a body portion having substantially square tube shape; and a housing comprising a cavity that receives the terminal fitting when the terminal fitting is inserted into the cavity, wherein the body portion comprises a first protrusion that protrudes from an outer surface of the body portion and an interference avoiding portion that is dented from the outer surface of the body portion, wherein the first protrusion and the interference avoiding portion are disposed to be opposed to each other substantially in a diagonal line on a virtual projection plane where the first protrusion and the interference avoiding portion are projected in a direction in which the terminal fitting is inserted into the cavity, and wherein the cavity is formed with, in an inner surface thereof, a first groove into which the first protrusion is allowed to enter only when the terminal fitting has a proper insertion posture relative to the cavity and an interference portion that is formed to swell from the inner surface of the cavity to narrow a gap with the interference avoiding portion.

2. The connector according to claim 1, wherein the body portion is formed by a plurality of wall portions, and wherein a boundary portion between adjacent two of the wall portions that are adjacent to each other substantially at right angles is dented to form the interference avoiding portion to have substantially quarter arc shape.

3. The connector according to claim 1, wherein the first protrusion is configured by a embossed protrusion formed on a wall portion of the body portion.

4. The connector according to claim 1, wherein a second protrusion is formed in the body portion so that the second protrusion protrudes in a different position of the outer surface of the body portion from the first protrusion and the interference avoiding portion on the virtual projection plane, and wherein a second groove that allows the second protrusion to be entered only when the terminal fitting has a proper insertion posture relative to the cavity is formed in the inner surface of the cavity.

5. The connector according to claim 4, wherein the second protrusion is formed in a wall portion that is opposed substantially in parallel to the wall portion where the first protrusion is formed, and wherein the second protrusion is positioned in an opposite edge portion to the interference avoiding portion in a width direction of the wall portion.

* * * * *